US005351446A

United States Patent [19]

Langsdorf

[11] Patent Number: 5,351,446

[45] Date of Patent: Oct. 4, 1994

[54] METHOD AND APPARATUS FOR THE ROTARY SAWING OF BRITTLE AND HARD MATERIALS

[75] Inventor: Karlheinz Langsdorf, Burghausen, Fed. Rep. of Germany

[73] Assignee: Wacker-Chemtronic Gesellschaft für Elecktronik-Grundstoffe mbH, Burghausen, Fed. Rep. of Germany

[21] Appl. No.: 938,691

[22] Filed: Sep. 1, 1992

[30] Foreign Application Priority Data

Oct. 15, 1991 [DE] Fed. Rep. of Germany ..... 4134110

[51] Int. Cl.[5] ..... B24B 1/00

[52] U.S. Cl. ..... 451/28; 451/69; 125/13.02; 125/21

[58] Field of Search ..... 51/5 C, 5 B, 281 R, 51/283 R, 326; 125/21, 13.02

[56] References Cited

U.S. PATENT DOCUMENTS

| | | | |
|---|---|---|---|
| 3,025,738 | 3/1962 | Winkler et al. | 82/70.2 |
| 3,039,235 | 6/1962 | Heinrich | 51/73 R |
| 4,712,535 | 12/1987 | Fujisawa | 125/13.01 |
| 4,756,796 | 6/1988 | Saitou | 51/5 C |
| 4,852,304 | 8/1989 | Honda et al. | 51/5 C |
| 4,881,518 | 11/1989 | Feldmeier | 51/5 C |
| 4,896,459 | 1/1990 | Brandt | 51/5 C |
| 4,899,719 | 2/1990 | Abe et al. | 125/14 |
| 4,903,681 | 2/1990 | Honda et al. | 125/14 |
| 4,967,725 | 11/1990 | Hinzen | 125/21 |
| 5,035,087 | 7/1991 | Nishiguchi et al. | 51/131.1 |
| 5,074,276 | 12/1991 | Katayama | 51/283 R |
| 5,111,622 | 5/1992 | Steere, Jr. | 51/283 R |

FOREIGN PATENT DOCUMENTS

| | | | |
|---|---|---|---|
| 3010867 | 10/1981 | Fed. Rep. of Germany . | |
| 2469259 | 5/1981 | France | 51/5 B |

*Primary Examiner*—Jack W. Lavinder
*Attorney, Agent, or Firm*—Collard & Roe

[57] ABSTRACT

Ingot-type semiconductor single crystals having diameters of more than 200 mm can be sawed into thin wafers using an annular saw if the crystal is fed towards the cutting edge of the annular saw while rotating around its longitudinal axis. The method includes having a wafer sawed out in this way until a residual joint is created between a wafer and the end face of the ingot. Ingot and wafer are finally separated by means of a residue separation technique which leaves behind various central material projections on the ingot and the wafer. Particularly suitable for residue separation are torsion separation and separation by a wire saw. This procedure reliably prevents the frequently observable, uncontrollable breaking-off of the wafer in the final phase of the annular sawing if this is exclusively used as the method of separation. The method, whose final step involves the removal of the material projection on the wafer by rotation grinding, proves to be particularly suitable for crystals having diameters of more than 200 mm. In this case, the material saving is exceedingly high as a result of the absence of chips from the ingot or wafer as a consequence of uncontrolled breaking-off of the wafer.

7 Claims, 6 Drawing Sheets

3
(7)

3
1
3
2
6
7

3
15
6
7
16

(7)
6

6

METHOD AND APPARATUS FOR THE ROTARY SAWING OF BRITTLE AND HARD MATERIALS

BACKGROUND OF THE INVENTION

1. Field of the Invention

The present invention relates to a method for the rotary sawing of brittle and hard materials, in particular of those having diameters exceeding 200 mm, into thin wafers by means of an annular saw and apparatus for performing the method.

In particular, the present invention relates to a method for the sawing of brittle and hard materials, in particular of semiconductor crystalline ingots or blocks, by means of an annular saw into thin wafers, in which the workpiece is moved towards the cutting edge of the saw while rotating.

2. The Prior Art

Crystalline ingots or blocks of semiconductor materials such as, in particular, silicon, germanium or gallium arsenide, are predominantly cut by means of annular saws into the thin wafers which are needed to produce devices. The saw blade of annular saws has the form of a circular disk and is clamped into a frame at its outer circumference. The inner circumference of the disk forms the cutting edge. As a rule, it is composed of a coating which is drop-shaped in cross-section and is composed of a metal such as, for example, nickel in which hard-material granules composed of diamond or boron nitride are bonded by electroplating. The grinding action of the rotating cutting edge on the workpiece produces the removal of semiconductor material. Depending on the design of the machine, the saw blade rotates in a horizontal or in a vertical plane. Taking account of the kerf width to be expected, the crystalline ingot is fed into the central opening of the circular disk to such an extent that wafers having the desired thicknesses are cut off when the ingot is then moved towards the cutting edge in an advancing movement parallel to the plane of rotation. Normally, the crystalline ingot is rigidly mounted on a feed carriage during this operation.

The requirements imposed on the quality of the wafers, which as a rule have a thickness of 0.1 to 1 mm, are very high. The maintenance of permitted tolerances relating to deviations in the plane-parallel geometry makes it very difficult, in particular, to produce wafers from crystalline ingots having large diameters exceeding 200 mm. The increase in saw blade outer diameter necessary for sawing such workpieces requires a thickness reinforcement of the saw blade since, without the thickness reinforcement, the latter would depart in an impermissible way from the ideal cutting line even in the event of slight differences in the forces acting perpendicularly to the plane of the saw blade as a consequence of deficient rigidity. However, an increase in the clamping forces to prevent an elastic deformation of the saw blade is possible only in the case of thickness-reinforced saw blades which are able to withstand these forces. Associated with the use of thicker saw blades, however, is an extremely disadvantageous material loss because of the increased kerf. If, on the other hand, cutting is carried out with a saw blade which is only enlarged radially, the wafer geometry defects, which usually manifest themselves in a thickness variation and/or in curved wafer planes familiar to the person skilled in the art under the descriptions "warp" and "bow," are unacceptably increased.

Although it is possible to correct such geometry defects, for example, by GS (grinding/slicing) cutting, the material loss due to correction increases with the severity of the defect. GS cutting is described in U.S. Pat. No. 4,896,459. The method combines the sawing operation with an end-face grinding of the crystalline ingot. As a result, every wafer cut off acquires a flat reference face and can be ground parallel to this plane in a subsequent treatment step.

U.S. Pat. No. 3,025,738 and U.S. Pat. No. 3,039,235 disclose the fact that the saw blade outside diameter needs only to be half as large if the workpiece is presented for sawing while rotating around the longitudinal axis instead of being mounted rigidly on a feed carriage. The machining of ingots having crystal diameters exceeding 200 mm is accordingly still possible with conventional saw blades whose dimensions would already be too small if the workpiece were fed without self-rotation, but which are still sufficiently rigid to keep geometry defects within the tolerance range.

The method described as rotary sawing has, however, serious disadvantages which arise from the fact that, because of the brittleness of the material, and as a consequence of the prevailing torsional and inertial forces which make themselves felt, in particular, in wafers having diameters of over 200 mm, the residual joint between ingot and wafer becomes so labile towards the end of the sawing operation that a spontaneous breakage often occurs. As a rule, this leaves behind in the center of the wafer or in the end face of the ingot an undesirable depression (center damage) whose removal requires a substantially more expensive subsequent grinding than in the case of the normal after-treatment of the wafer surfaces. It is not uncommon for the center damage to extend so deeply into the interior of the wafer that the entire wafer is unusable. The uncontrolled breaking-off of the wafer is always accompanied by an unacceptable material loss.

All the efforts hitherto undertaken by those skilled in the art to counteract center damage had the objective of completing the cutting operation using the annular saw without random breakage of the residual joint between crystalline ingot and wafer. Thus, for example, German Offenlegungsschrift 30 10 867 presents a take-up device which rotates synchronously with the crystalline ingot and which is intended to stabilize the wafer adequately until it is separated from the ingot in a controlled manner. Such a safety measure is, however, complicated and costly and in particular, is unreliable in the case of wafer diameters exceeding 200 mm.

As a consequence, therefore, the sawing method which has been mentioned and in which the crystalline ingot is fed without self-rotation is routinely used in industry. Normally, the workpiece is cemented onto a sawing strip made of graphite or carbon so that even after being cut from the ingot, the wafer is held in position. If the cutting edge starts to penetrate the sawing strip, a vacuum pick-up is brought up, applies suction to the wafer and transports it away from the sawing area after the strip has been cut through. Although this procedure makes center damage to the wafer or the ingot impossible, it does not prevent the problems with the wafer geometry which have been mentioned and which arise in sawing workpieces having diameters exceeding 200 mm.

SUMMARY OF THE INVENTION

It is therefore an object of the present invention to provide a method of sawing by means of an annular saw and an apparatus for performing it, with which method ingot-type workpieces, in particular those having diameters exceeding 200 mm, are sawed into wafers while self-rotating, in which process center damage to the ingot or wafer is reliably avoided.

This object is achieved according to the present invention by providing a method for the sawing of a workpiece ingot of a brittle and hard material by means of an annular saw with a saw blade having a cutting edge into a thin wafer, in which the workpiece ingot is moved towards the cutting edge of the saw blade while the ingot is rotating around the ingot longitudinal axis, this ingot having an end face with central material projections, which method comprises the steps of surface grinding of the end face of the ingot to remove the central material projections while the workpiece is rotating; rotary sawing of the workpiece with the annular saw to produce a residual joint between the wafer and the ingot, while preserving the residual joint between the wafer and the ingot; separating the wafer and the ingot by residue cutting of the residual joint which leaves behind central material projections from the residual joint on the ingot and on a cut wafer; and rotary grinding of the cut wafer to remove the central material projections therefrom.

The object is furthermore achieved by an apparatus for the sawing of a workpiece ingot of a brittle and hard material by means of an annular saw blade into a thin wafer, in which the workpiece ingot is moved towards a cutting edge of the saw blade while the ingot is rotating around the ingot longitudinal axis, this ingot having an end face with central material projections, which apparatus comprises means for surface grinding of the end face of the ingot to remove the central material projections while the workpiece is rotating, means for rotary sawing of the workpiece with the annular saw while preserving a residual joint between the wafer and the ingot, means for separating the wafer from the ingot by means of a residue cutting means which leaves behind central material projections on the ingot and a cut wafer, means for rotary grinding of the cut wafer to remove the central material projections therefrom; and wherein the annular saw and the means for the end-face grinding of the ingot and the means for separating ingot and wafer by the residue cutting means are integrated into one machine.

Surprisingly, it has in fact been found that the method according to the invention makes it possible to integrate the end phase final steps into the procedure. This end phase has hitherto been regarded as a prior art problem in connection with the rotary sawing operation for separating the wafer from the ingot. The present invention provides a logical method sequence in which the advantages of rotary sawing are achieved without the disadvantages referred to by the concept of center damage having to be accepted.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views:

FIG. 1 shows diagrammatically the several machining steps which the ingot and the wafer pass through in the course of the method according to the invention, in which:

FIG. 1*a* shows in the first step of the method that the end face of the ingot needs to be surface ground so as to remove the central material projection which has been left behind on the ingot as a result of cutting the preceding wafer;

FIG. 1*b* shows the end face of the ingot being ground while rotating the ingot about its longitudinal axis and also with rotation of the grinding apparatus itself;

FIG. 1*c* shows cutting a wafer from the ingot using an annular saw while rotating the ingot, this cutting being to such an extent that the wafer remains joined to the ingot only by a rotationally symmetrical material residue in the center of the wafer;

FIG. 1*d* shows the use of a wire saw to carry out the cutting of the residue shown in FIG. 1*c;*

FIG. 1*e* shows that after cutting to produce a wafer, a central material projection is left behind both on the ingot (FIG. 1*a*) and on the wafer;

FIG. 1*f* shows a rotating grinding wheel for removing the central material projection from the wafer lying horizontally on a holding surface;

DETAILED DESCRIPTION OF PREFERRED EMBODIMENTS

Figures 1, 1A, 1B, 1C, 1D, 1E, 1F:
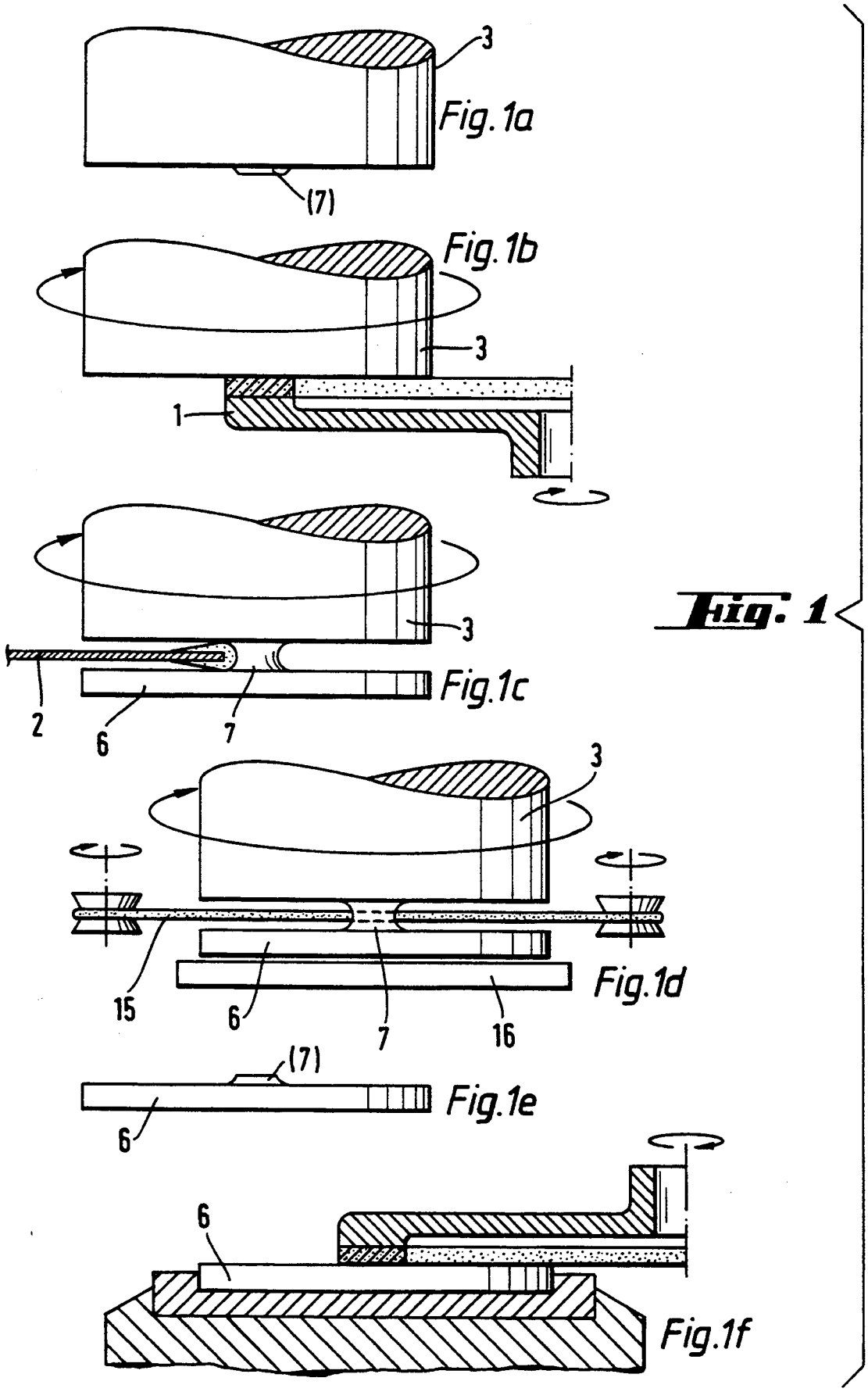

Turning now in detail to the drawings, FIG. 1 shows diagrammatically the individual machining steps which the ingot and the wafer pass through in the course of the method according to the invention. The ingot can be a semiconductor single crystal made of silicon, for example, having a diameter greater than or equal to 200 mm.

In the first step of the method, the end face of the ingot workpiece is surface ground. The surface grinding of the end face of the ingot 3 removes the central material projection or nipple (7) which has been left behind on the ingot as a result of cutting the preceding wafer (FIG. 1*a*). At the same time the flat reference plane is produced, by reference to which the wafer to be freshly sawed can be ground in a plane-parallel manner. The end face of the ingot is preferably ground while rotating the ingot about its longitudinal axis and also with rotation of the grinding apparatus itself (FIG. 1*b*). In this connection, it is irrelevant whether the rotary movements are performed in the same or opposite directions. Of course, it is also possible to move a non-rotating ingot horizontally towards a rotating grinding edge, even if this embodiment is more complicated and less space-saving.

In subsequent steps of the method, a wafer 6 is cut out using an annular saw 2 while rotating the ingot itself. This cutting occurs to such an extent that the wafer remains joined to the ingot 3 only by a rotationally symmetrical material residue 7 in the center of the wafer (FIG. 1*c*). For wafers having diameters exceeding 200 mm, the diameter of this residual joint is still at least 1 mm at its narrowest point. At any rate, the sawing operation must be terminated before an uncontrolled breaking off of the wafer can occur. Expediently, the optimum thickness of the residual joint is determined in preliminary experiments.

The wafer and the ingot are separated from each other in a controlled manner in the next step of the method sequence by using a residue cutting technique which is an alternative to annular sawing. In a preferred embodiment for the residue cutting step of the method, a wire saw 15 is used (FIG. 1*d*). Characteristic of the residue cutting technique is that a central material projection (7) is left behind both on the ingot and on the wafer (FIGS. 1*a* and 1*e*). A wire saw fulfills this requirement since, normally, the wire diameter is markedly less than the thickness of the cutting edge of the annular saw. According to the invention, the saw blade of the annular saw 2 is replaced by a sawing wire 15 which is coated with diamond particles and runs over deflection rollers and which cuts the residual joint 7 in the desired manner with the workpiece, either stationary or rotating. It is particularly advantageous to stabilize this operation using a vacuum holding means 16 which applies a vacuum to the free wafer surface and holds the wafer in position. After wafer and ingot have been separated, the holding means is expediently used to transport the wafer out of the sawing area and to put it down, for example, in a prepared processing tray.

Another particularly advantageous residue separation technique can be carried out without prior removal of the saw blade of the annular saw from the kerf. Surprisingly, it was found that the wafer 6 fixed in position by the vacuum holding means 16 can be removed by rotation from the ingot 3 as a result of suitable incipient rotation of the ingot, with the production of the desired nipple on the ingot and the wafer. This separation technique, referred to as torsion separation, has the advantage that no special alternative cutting device in addition to the annular saw is required.

Figure 3:
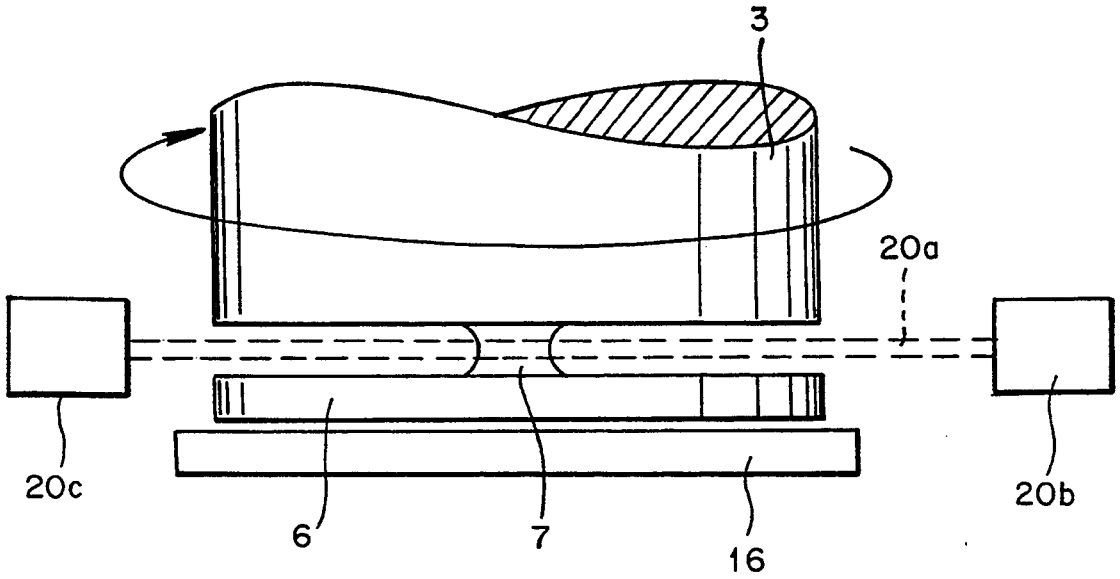
FIG. 3 shows the use of an alternative separation technique to carry out the cutting of the residue shown in FIG. 1*c.*

Wire sawing and torsion separation are to be understood as being examples of preferred separation techniques without being limitative of the present invention in any manner thereof. In addition, a number of other residue separation techniques are suitable for performing the separation of ingot and wafer in accordance with the invention. In this regard, suitable examples include the use of laser beam, water jet, abrasive jet, shock wave, thermal and vibration period fracture separation means. FIG. 3 shows the use of one of these separation techniques 20*a* which is regulated by control means 20*b* and 20*c*. Technique 20*a* is alternative to the wire sawing shown in FIG. 1*d*, and illustrates the use of laser beam, water jet, abrasive jet, shock wave, thermal fracture and vibration period fracture separation means.

In the last processing step associated with the method according to the invention, the nipple (7) remaining behind on the wafer surface is removed with the object of providing a surface which is planar, and which is parallel to the reference surface on the other side of the wafer 6. Expediently, this removal step is postponed until a processing tray has been filled with wafers.

Particularly advantageously, the wafers are subjected, individually or in groups, to the rotary grinding disclosed by U.S. Pat. No. 5,035,087, which is also known to the person skilled in the art under the description "infeed grinding." The method, in which a rotating diamond grinding wheel is lowered with μm precision onto the silicon wafer lying horizontally on a holding tray (FIG. 1*f*) is notable for the high geometrical quality of the treated and polished wafer surfaces.

The method according to the invention makes it possible, with particular advantage, to saw semiconductor crystalline ingots having diameters exceeding 200 mm into thin wafers, although, of course, the machining of ingots having smaller diameters is also possible. It is particularly notable for the fact that annular saws can be used which are already available on the market and with which thinner ingots have hitherto already been cut satisfactorily without the machines having to be re-equipped with saw blades having larger outside diameters and necessarily increased saw blade thicknesses. The geometry defects on the large wafers remain within the same tolerance limits as are also expected in the case of the smaller wafers. In addition, the increased material losses otherwise normal in rotary sawing as a consequence of the unintended breaking-off of the wafer from the ingot shortly before the termination of the sawing operation with the annular saw is completely avoided. Time is saved when compared with annular sawing with feeding of the ingot without self-rotation. This results from the fact that the cementing of a sawing strip to the ingot is unnecessary and the de-cementing of the strip part from the wafer is also unnecessary.

FIGS. 2*a*–2*d* show an example in a non-limitative manner, of a particularly preferred embodiment of an apparatus for performing the method of the invention. Identical apparatus features are provided with identical reference numerals. For the sake of clarity, only the machine parts which are important for understanding the mode of operation are shown.

An annular saw and devices for end-face grinding of the ingot and for separating the ingot and the wafer after the residue cutting technique are integrated into the same machine described below, with the result that up to three of the four processing steps associated with the method according to the invention can be combined together. Only the rotary grinding of the cut wafer is carried out in a separate grinding apparatus.

Figure 2A:
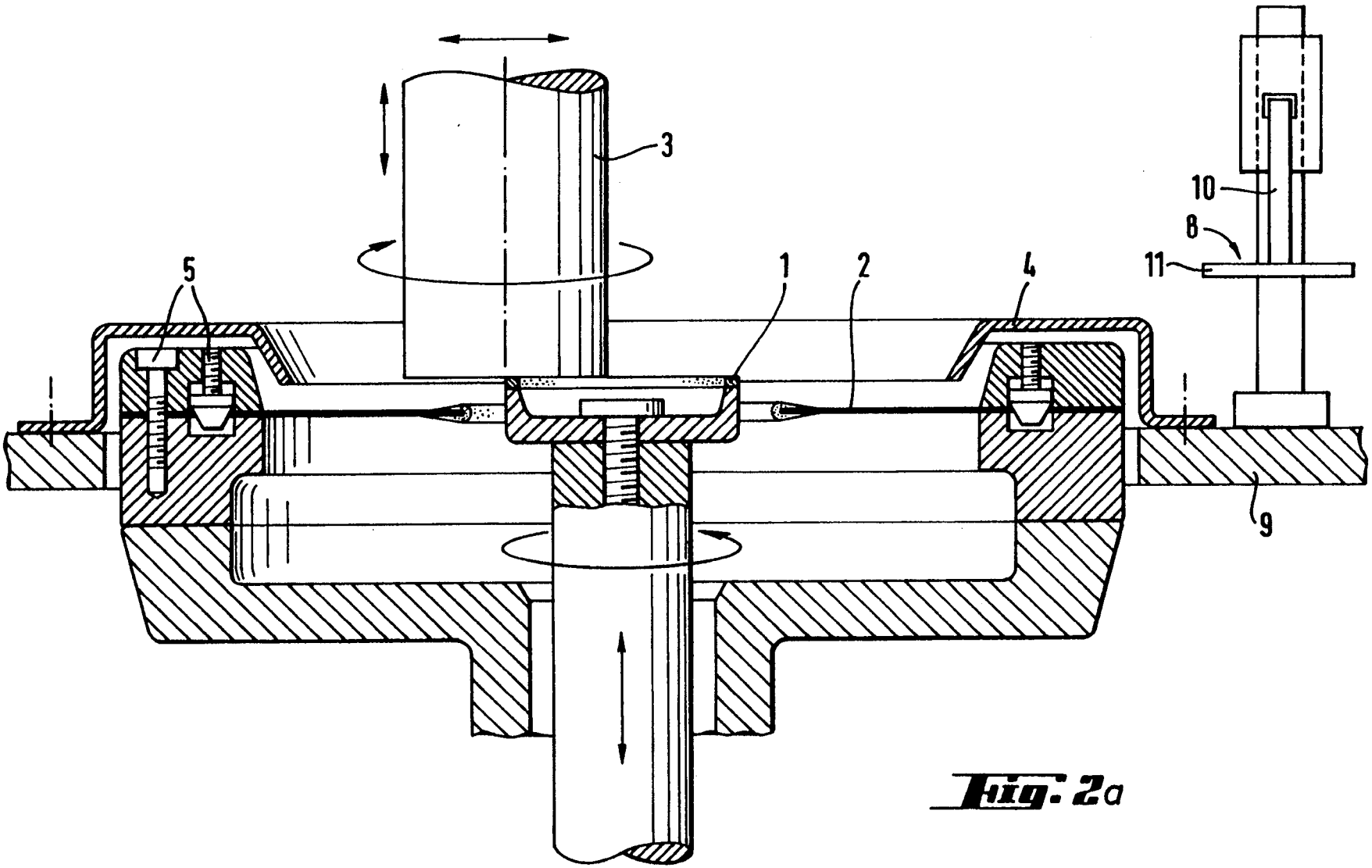
FIG. 2*a* shows a partial section view of the apparatus during the grinding of the end face of the ingot at the beginning of the procedure according to the method of the invention.

FIG. 2*a* shows a partial cross-section view of the apparatus during the grinding of the end face of the ingot 3 at the beginning of the method according to the invention. At this point in time, the rotating grinding wheel 1 is in its working position just above the plane of rotation of the saw blade 2 of the annular saw. The feed device which lowers the crystalline ingot 3 vertically from a position above the boundary formed by a protective cover 4, of the annular saw into its working position and an apparatus for rotating the ingot are known per se and are omitted in the figures.

In a preferred embodiment, the ingot and the grinding wheel rotate in opposite directions during the grinding of the end face of the ingot. The axes of rotation of the grinding device and of the crystalline ingot extend in parallel and are offset by approximately half the diameter of the ingot with respect to one another. The grinding wheel can be raised and lowered along its axis of rotation through the circular opening formed by the saw blade. This saw blade is clamped over its outside circumference in a frame in a manner known to the person skilled in the art and is rigidly linked to the latter by a clamping system 5.

Figure 2B:
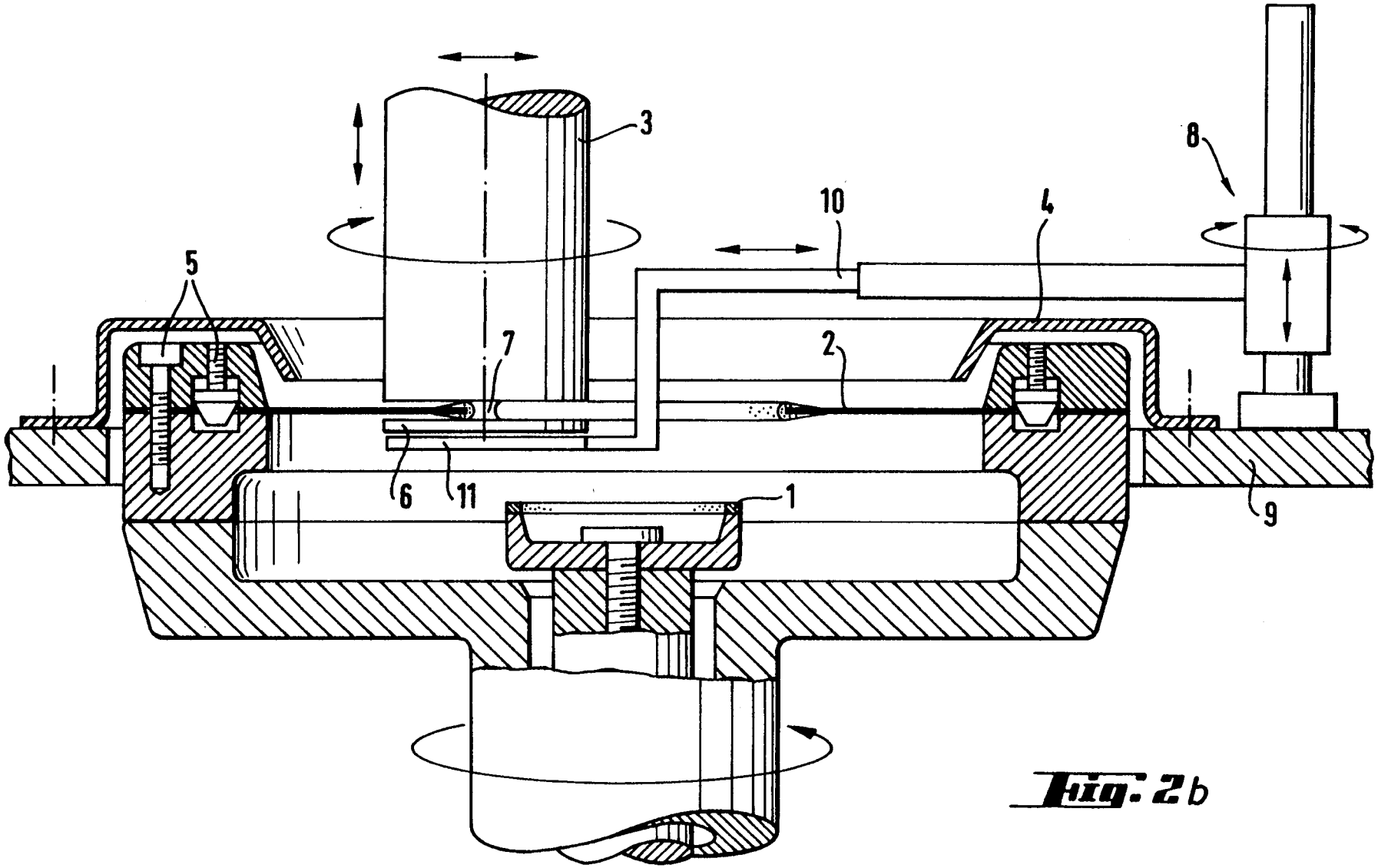
FIG. 2*b* shows the grinding wheel at rest being moved into a plane below the plane of the annular saw blade.

FIG. 2*b* shows the rest position in which the grinding wheel 1 is moved into a plane below the plane of the saw blade 2. As further shown in FIG. 2*b*, a semiconductor wafer 6 is sawed out of the ingot 3 with the aid of the annular saw 2 until a residual joint 7 remains. At this point in time, the rotating crystalline ingot is fed into the circular opening of the saw blade and is moved toward the cutting edge over a specified distance. A vacuum for holding the wafer 6 can readily be applied to, and support is provided for, the semiconductor wafer by a vacuum pickup and holding unit 8 which is swivelled horizontally into its working position. The pickup unit is appropriately attached to the machine frame 9 and is designed in such a way that the pickup arm 10, at the end of which the pickup plate 11 is located, can be both raised and lowered vertically, and also swivelled horizontally, and can be extended or retracted in its range of action. The arm 10 is bent twice at right angles in order to make lowering of the plate 11 into the annular hole of the saw blade possible.

The vacuum pickup unit 8 has an additional useful function if torsion separation is to be used for the complete cutting of, and separation of, the wafer 6 from the ingot 3 as the residue separation technique. It now functions as a thrust bearing to which the hitherto free end of the ingot is firmly linked. The position of the ingot initially does not need to be altered further for this use. The residual joint 7 is broken and the wafer 6 is separated by incipiently rotating the ingot which is at rest. The pickup then conveys the wafer to a processing tray for the further transport to rotary grinding, which is the final treatment in the method according to the invention.

On the other hand, if the residual joint 7 is to be separated by using a wire saw, the ingot 3 is raised out of the opening of the saw blade and, for example, fed to an external wire saw which is not shown. In a preferred further embodiment of the present invention, the wire saw is accommodated in the same machine housing with the grinding device 1 and the annular saw 2.

Figure 2C:
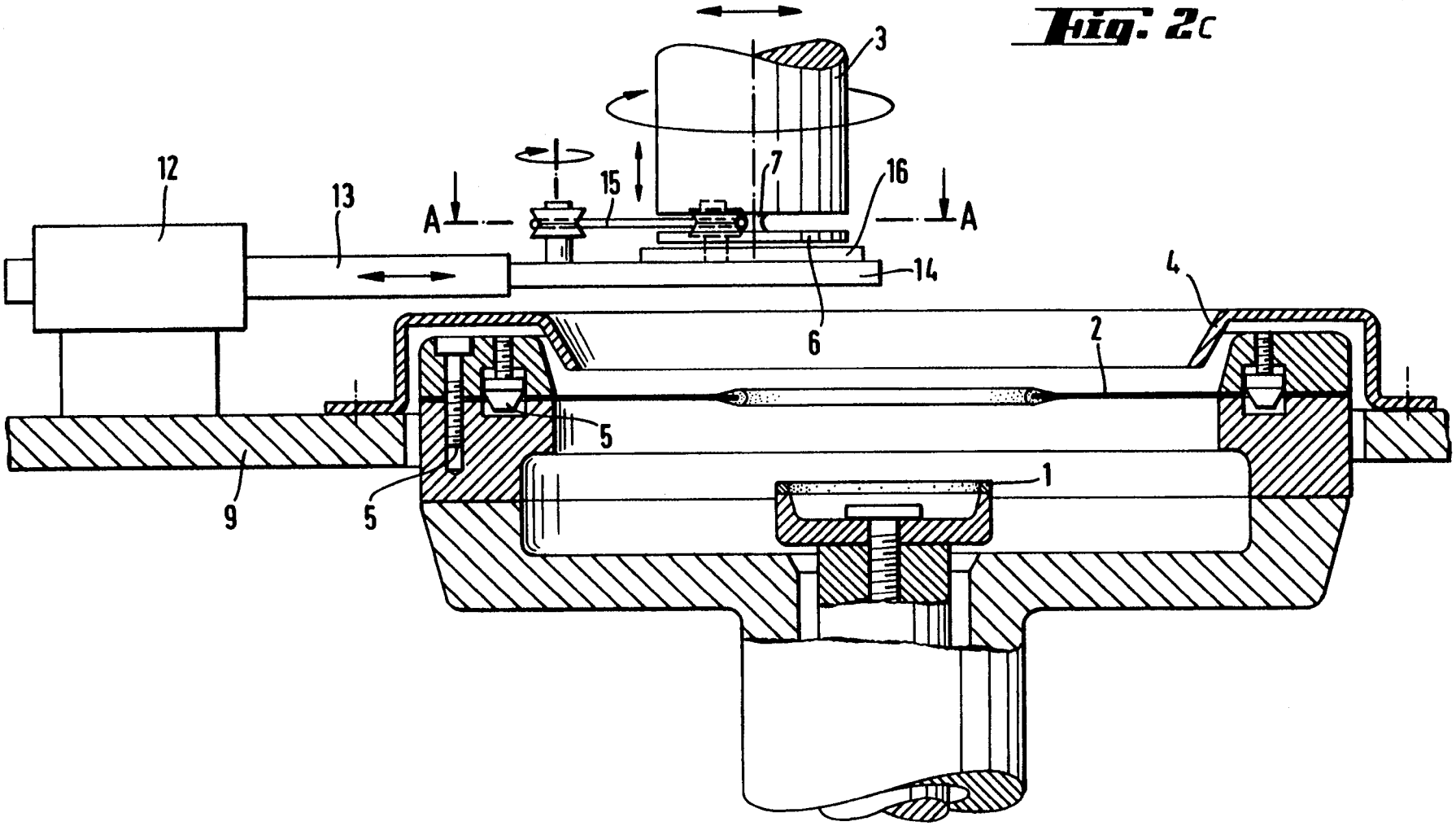
FIG. 2*c* shows a wire saw accommodated in the same machine housing with the grinding wheel and the annular saw.
Figure 2D:
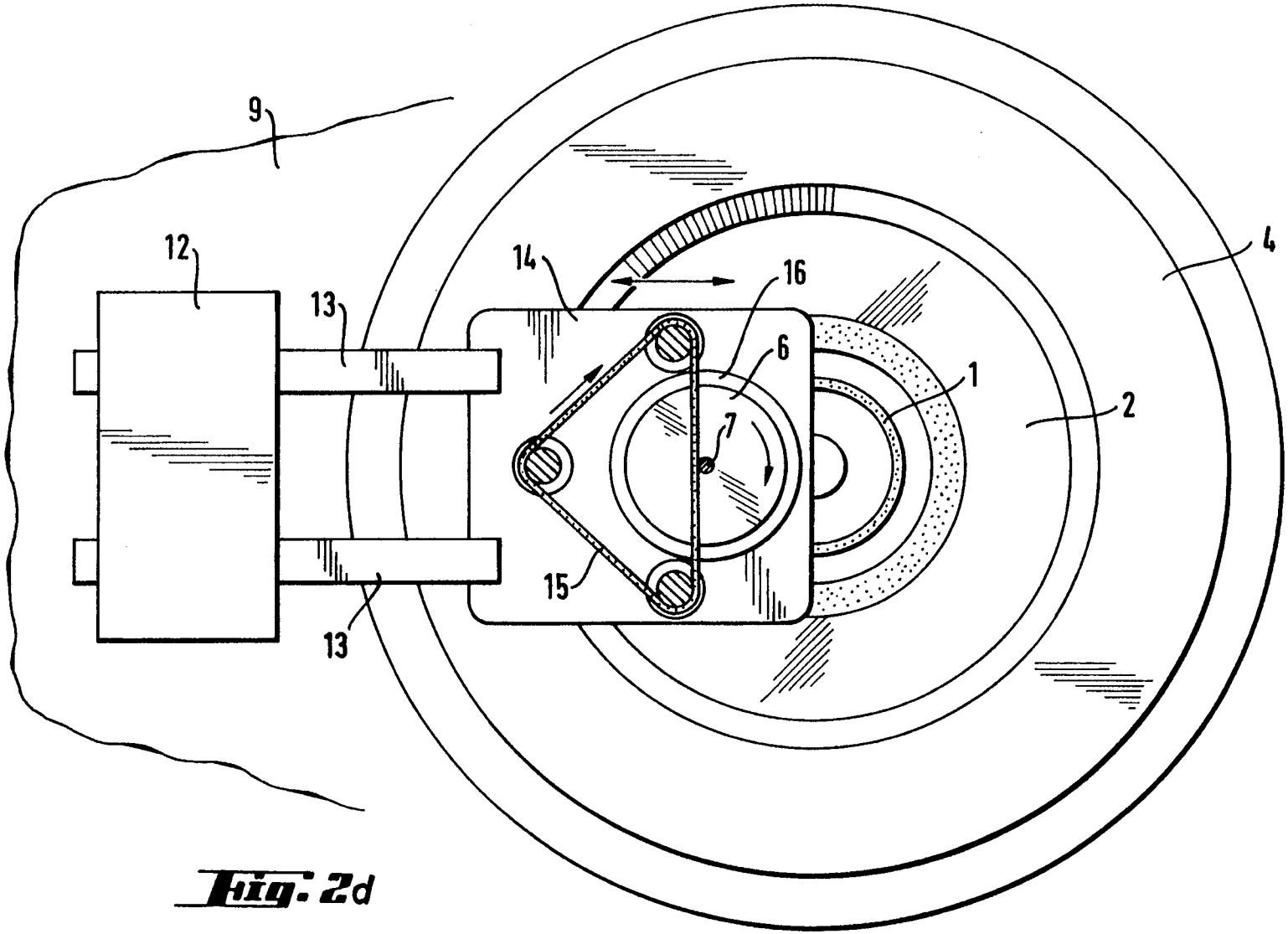
FIG. 2*d* shows a cross-section along line A—A of FIG. 2*c;*

FIG. 2*c* shows another particularly advantageous embodiment which includes a wire saw device. The plan view of the plane produced by the section line A—A is shown in FIG. 2*d*. The wire saw device comprises a mounting 12 attached to the machine frame 9 and having, for example, a double-arm beam 13 with support plate 14. The cutting tool or wire 15 is mounted on the support plate. It is formed by a cutting wire 15 which is coated with diamond particles and runs over deflection rollers. At least one of the rollers is driven, the drive preferably being accommodated in the shaft of the roller. It is also possible to provide the drive underneath the support plate 14. The cutting wire is advanced towards the residual joint 7 of ingot 3 and wafer 6 by means of beam 13 which can be moved horizontally. It is particularly advantageous to provide on the support plate 14 a pickup plate 16 onto which the cut wafer can drop. Also, the pickup plate 16 can include a vacuum pickup and apply a vacuum to the wafer 6 while it still has not yet been separated from the ingot. The silicon wafer 6 is released by retracting the beam 13 and transporting the wafer in the usual manner for further treatment in accordance with the method according to the invention.

The present invention has the further advantages that the compact, modular construction of the apparatus is highly space-saving and is very easy to maintain. The method of the invention is consequently effectively achieved.

While several embodiments of the present invention have been shown and described, it is to be understood that many changes and modifications may be made thereunto without departing from the spirit and scope of the invention as defined in the appended claims.

What is claimed is:

1. A method for the sawing of a workpiece ingot of a brittle and hard material into thin wafers, said ingot having an end face with central material projections, and said ingot having a longitudinal axis, which method comprises the steps of:

grinding the end face of said workpiece ingot to remove said central material projections while the workpiece ingot is rotating;

sawing the workpiece ingot by means of an annular saw to produce a wafer, the workpiece ingot being rotated around said longitudinal axis;

terminating said sawing by means of said annular saw, said wafer remaining joined to the ingot by a residual joint, having a narrowest point;

separating the wafer from the workpiece ingot by means of a separation technique, which is alternative to said sawing by means of an annular saw and which leaves behind central material projections from said residual joint both on the workpiece ingot and on the wafer separated therefrom; and grinding said wafer to remove said central material projections on the wafer.

2. The method as claimed in claim 1, comprising terminating said sawing by means of the annular saw when the residual joint between the wafer and the ingot workpiece still has a diameter of at least 1 mm at said narrowest point.

3. The method as claimed in claim 1, wherein the workpiece ingot of said brittle and hard material is an ingot of crystalline semiconductor material having a diameter exceeding 200 mm.

4. An apparatus for the sawing of a workpiece ingot of a brittle and hard material into thin wafers, said ingot having an end face with central material projections, and said ingot having a longitudinal axis, which apparatus comprises:

a machine frame;

means mounted on said machine frame for grinding said end face of said workpiece ingot to remove said central material projections;

an annular saw mounted on said machine frame for cutting the workpiece ingot while it rotated around said longitudinal axis to produce a wafer, said wafer remaining joined to the workpiece ingot by a residual joint; and a wire saw mounted on said machine frame to separate the wafer from the workpiece ingot leaving behind central material projections from said residual joint both on the ingot and on the wafer separated therefrom.

5. A method for the sawing of a workpiece ingot of a brittle and hard material into thin wafers, said ingot having an end face with central material projections, and said ingot having a longitudinal axis, which method comprises the steps of:

grinding the end face of said workpiece ingot to remove said central material projections;

sawing the workpiece ingot by means of an annular saw to produce a wafer, the workpiece ingot being rotated around said longitudinal axis;

terminating said sawing by means of said annular saw, said wafer remaining joined to the ingot by a residual joint;

separating the wafer from the workpiece ingot by means of a separation technique, which is alternative to said sawing by means of an annular saw and which leaves behind central material projections from said residual joint both on the workpiece ingot and on the wafer separated therefrom, said separation technique being selected from the group consisting of wire sawing, laser beam separation, water jet separation, abrasive jet separation, vibration period fracture separation, and thermal separation; and grinding said wafer to remove said central material projections on the wafer.

6. The method as claimed in claim 5, wherein said separation technique, which is alternative to the sawing by means of an annular saw and which leaves behind central material projections from the residual joint both on the workpiece ingot and on the wafer separated therefrom, is selected from the group consisting of wire sawing, laser beam separation, and water jet separation.

7. The method as claimed in claim 5, wherein said separation technique, which is alternative to the sawing by means of an annular saw and which leaves behind central material projections from the residual joint both on the workpiece ingot and on the wafer separated therefrom, is wire sawing.

* * * * *

UNITED STATES PATENT AND TRADEMARK OFFICE

CERTIFICATE OF CORRECTION

PATENT NO. : 5,351,446

DATED : October 4, 1994

INVENTOR(S) : Karlheinz LANGSDORF

It is certified that error appears in the above-identified patent and that said Letters Patent is hereby corrected as shown below:

Cover page, item 73, delete "Wacker-Chemtronic Gesellschaft für Elecktronik-Grundstoffe mbH" and insert --Wacker-Chemitronic Gesellschaft für Elektronik-Grundstoffe mbH--.

Signed and Sealed this

Twenty-fourth Day of January, 1995

*Attest:*

Bruce Lehman

BRUCE LEHMAN

*Attesting Officer*

*Commissioner of Patents and Trademarks*